US005685032A

United States Patent [19]

Watkins et al.

[11] Patent Number: 5,685,032

[45] Date of Patent: *Nov. 11, 1997

[54] PORTABLE SPA WITH INTEGRAL BOTTOM PAN, INTERCHANGEABLE SIDE SKIRT, AND INTERLOCKING COVER

[75] Inventors: Jeffrey King Watkins, Rancho Santa Fe; Walter Richard Cumiskey, Vista; Phillip Dudley Loizeaux, San Marcos, all of Calif.

[73] Assignee: Watkins Manufacturing Corp., Vista, Calif.

[ * ] Notice: The term of this patent shall not extend beyond the expiration date of Pat. No. 5,564,137.

[21] Appl. No.: 691,299

[22] Filed: Aug. 1, 1996

Related U.S. Application Data

[60] Continuation of Ser. No. 357,414, Dec. 16, 1994, Pat. No. 5,564,137, which is a division of Ser. No. 205,624, Mar. 3, 1994, Pat. No. 5,428,849.

[51] Int. Cl.[6] ..... A47K 3/02; E04H 4/14

[52] U.S. Cl. ..... 4/506; 4/584

[58] Field of Search ..... 4/506, 538, 541.1, 4/580, 584, 901; 2/211, 220; 47/72; 52/3; 150/154, 901; 220/400, 732

[56] References Cited

U.S. PATENT DOCUMENTS

| | | | |
|---|---|---|---|
| 716,668 | 12/1902 | Cheney | 47/72 |
| 1,647,169 | 11/1927 | Anton | 150/154 |
| 2,142,301 | 1/1939 | Buchalter | 47/72 |
| 2,540,372 | 2/1951 | Lowry | 2/211 |
| 3,004,769 | 10/1961 | Turner | 4/608 X |
| 3,324,480 | 6/1967 | Williams | 2/211 |
| 3,731,321 | 5/1973 | Dyche | 2/211 |
| 3,797,043 | 3/1974 | Brument | 2/211 X |
| 3,905,414 | 9/1975 | Geubert et al. | 4/608 X |
| 4,126,719 | 11/1978 | Koyanagi et al. | 4/538 X |
| 4,206,575 | 6/1980 | Leonard | 52/3 X |
| 4,213,539 | 7/1980 | Reuter | 220/343 X |
| 4,260,569 | 4/1981 | Hurst | 264/45.4 |
| 4,290,154 | 9/1981 | Benjamin | 4/538 |
| 4,391,386 | 7/1983 | Moret | 220/343 |
| 4,586,204 | 5/1986 | Daniels | 4/541.4 |
| 4,603,521 | 8/1986 | Engelhart | 4/506 X |
| 4,787,366 | 11/1988 | Bell | 52/3 X |
| 4,843,659 | 7/1989 | Popovich et al. | 4/541.3 |
| 4,853,985 | 8/1989 | Perry | 4/498 |
| 4,857,374 | 8/1989 | Perry | 4/498 X |
| 4,981,543 | 1/1991 | Popovich et al. | 156/191 |
| 5,092,951 | 3/1992 | Popovich et al. | 156/184 |
| 5,133,818 | 7/1992 | Popovich et al. | 156/184 |
| 5,199,116 | 4/1993 | Fischer | 4/541.2 |
| 5,248,057 | 9/1993 | Taylor | 220/333 |
| 5,428,849 | 7/1995 | Watkins et al. | 4/541.1 |

FOREIGN PATENT DOCUMENTS

| | | | |
|---|---|---|---|
| 0362933 | 4/1990 | European Pat. Off. | 4/593 |
| 2076622 | 10/1971 | France | 4/592 |
| 2040676 | 9/1980 | United Kingdom | 4/593 |

OTHER PUBLICATIONS

Ideal–Standard, Translation of FR 2,076,622.

Flyer of Hot Spring Portable Spas re "The Tip Top" Spa Cover, 1991, 2 pgs.

Brochure of the Centech Corporation entitled, "Tub Cap" (no date), 4 pgs.

Brochure of Softub entitled, "Series by Softub", Jun. 1993, 8 pgs.

Flyer of Softub re "Softop" (no date), 1 pg.

Brochure of Softcare entitle, "Softcare Essentials" (1993), 8 pgs.

*Primary Examiner*—Robert M. Fetsuga

*Attorney, Agent, or Firm*—Price, Gess & Ubell

[57] ABSTRACT

A portable spa including a cover having two rigidly molded, interlocking halves, designed to conform with the contour of the rim of the spa. The rim includes a vertical extension which interfits with an extrusion used to attach an interchangeable decorative vinyl-covered skirt about the side surface of the spa. The spa structure is supported by an integral molded bottom pan, which provides an upper edge or rim against which the lower edge of the skirt is secured.

29 Claims, 6 Drawing Sheets

40
41
42
43
44
45
46
47
48
50

PORTABLE SPA WITH INTEGRAL BOTTOM PAN, INTERCHANGEABLE SIDE SKIRT, AND INTERLOCKING COVER

This application is a continuation of prior application Ser. No. 08/357,414, filed on Dec. 16, 1994, U.S. Pat. No. 5,564,137, which application is a division of application Ser. No. 08/205,624, filed Mar. 3, 1994, which issued as U.S. Pat. No. 5,428,849, on Jul. 4, 1995.

BACKGROUND OF THE INVENTION

1. Field of the Invention

The subject invention relates to spas, whirlpools, and the like and, more particularly, to improvements in portable spas.

2. Description of Related Art

Portable spas are generally known in the prior art and have become increasingly popular as a source of relaxation and physical therapy. Their structure generally includes a spa shell or "tub" fabricated of various materials such as fiberglass/acrylic or various thermoplastics, a layer of thermal insulation placed against the shell, and a wooden support structure, often employing a 2×4 frame. In many cases, the exterior of the spa is a continuation of the shell. In some cases, decorative redwood patterns have been applied to serve as the exterior sidewalls or "skirts" of free-standing units. Decorative tile work has also been variously used in the interior and exterior design of portable spas.

Another known portable spa design employs a "soft core"—an inner annular core of "spongy" foam—together with a vinyl outer surface sewn to an inner vinyl liner much like a vinyl pool liner. The bottom of the spa is formed of a flat sheet of thin plastic cut, e.g., by scissors and stapled to the soft foam core. Because of its structure, the spa equipment, such as heaters and pumps, must be located remote from the spa.

In order to retain heat and reduce evaporation, portable spas have been fitted with insulating covers. The most commonly used cover is made of cut styrofoam halves surrounded by a sewn vinyl covering and permanently hinged together. This structure provides a flat cover, which is simply slid over the top of the spa when the spa is not in use. Another known spa cover for use with the "soft core" design is formed of one-piece polyethylene foam with a hand-sewn cover and fits into the spa like a cork. Other covers have employed foam cores with more resilient rigid covering materials and have employed various spring-biased hinged mechanisms for raising and lowering because of their considerable weight.

To meet industry safety standards such as ASTM F1346-91, spa covers must meet static load, deflection, and surface drainage standards. Under ASTM F1346-91, a spa cover must support a weight of 485 pounds. A deflection test must be met to ensure that if a child under five falls on the cover, he cannot slip through any openings. The surface drainage standard ensures that the cover will not retain enough water to risk drowning of a small child.

The prior art designs referenced above have a number of drawbacks. Exposed or partially protected bottom surfaces of many conventional spas are subject to attack by rodents and weather. While generally attractive, the decorative exterior of the spa is not always suited to the particular aesthetics of the moment. The conventional spa covers are labor intensive to manufacture, cumbersome to use, and have a notoriously short life span in the face of hot chlorinated water, sunlight, and the wear and tear of use. Many of the designs, such as the soft core "cork," cannot meet industry safety standards.

OBJECTS AND SUMMARY OF THE INVENTION

It is therefore an object of the invention to improve various aspects of spa design;

It is another object of the invention to improve portable spa design;

It is another object to increase the life of covers used in conjunction with spas;

It is another object to improve the ease of use of spa covers;

It is another object to provide a spa cover design which is relatively lightweight and easy to use and which can meet industry safety standards;

It is yet another object to improve the resistance of portable spas to weather, rodents, and other degrading factors; and It is still another object to provide a decorative, interchangeable skirt to improve the appearance and utility of portable spas.

According to the invention, an improved portable spa structure integrating several novel aspects into the overall design is provided. The spa includes a lid or cover with rigidly molded, interlocking halves, designed to rest on the upper rim of the spa. An interchangeable decorative skirt wraps about the side of the spa, providing a decorative feature readily changed by the user. The skirt is retained by an extrusion member which interfaces between the upper rim of the spa and the skirt. At its lower edge, the skirt meets an integrally molded bottom pan, which supports the entire structure and is impervious to the elements.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide readily manufacturable and particularly useful portable spa improvements.

Figure 1:
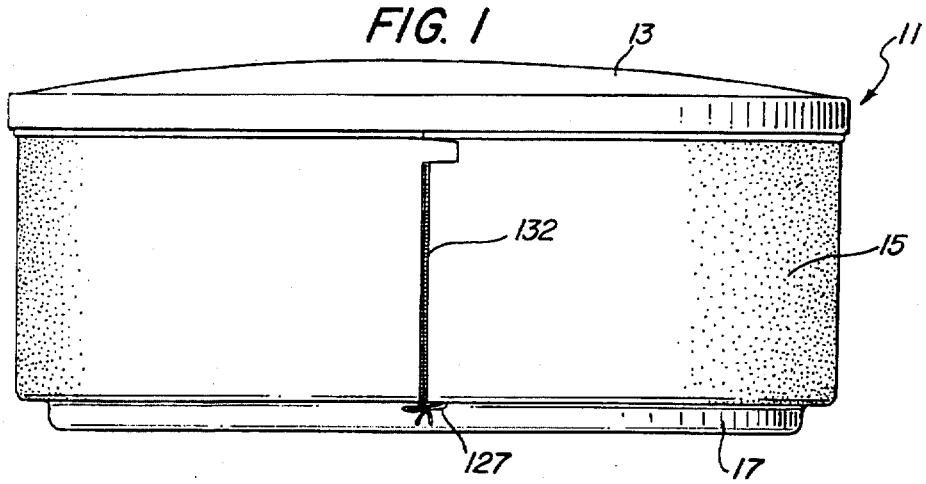
FIG. 1 is a side elevational view of a spa according to the preferred embodiment.

FIG. 1 illustrates a spa 11 according to the preferred embodiment including a cover 13, a decorative, interchangeable side skirt 15, and a bottom pan 17. The skirt 15 includes a zipper 132 and is removable and replaceable by skirts of, for example, different colors.

Figure 2:
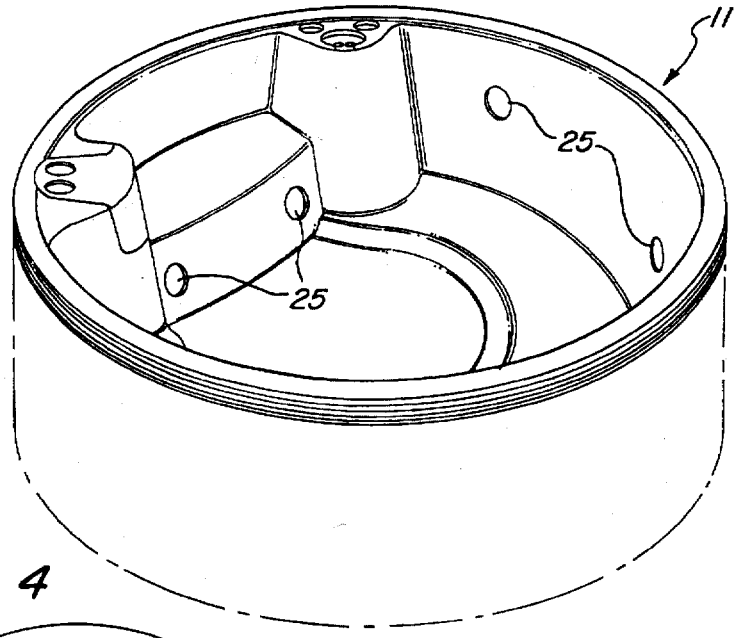
FIG. 2 is a perspective view of a typical spa according to the preferred embodiment with the cover removed.
Figure 4:
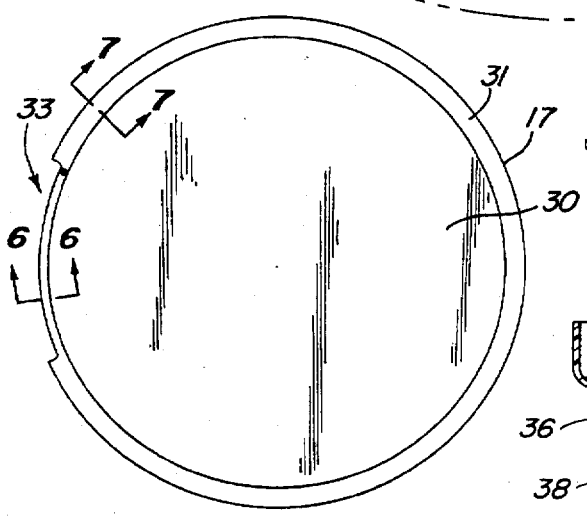
FIG. 4 is a top view of a spa base according to the preferred embodiment.
Figure 5:
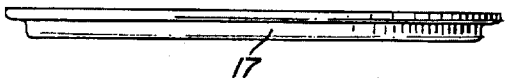
FIG. 5 is a side view of the base of FIG. 4.
Figure 6:
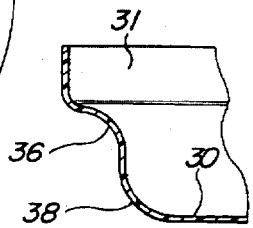
FIG. 6 is a sectional view taken at 6—6 of FIG. 4.

FIG. 2 shows a typical interior configuration of the spa 11, including jet openings 25 and seating areas. The particular interior detail is, of course, variable, as will be appreciated by those skilled in the art.

Figure 3:
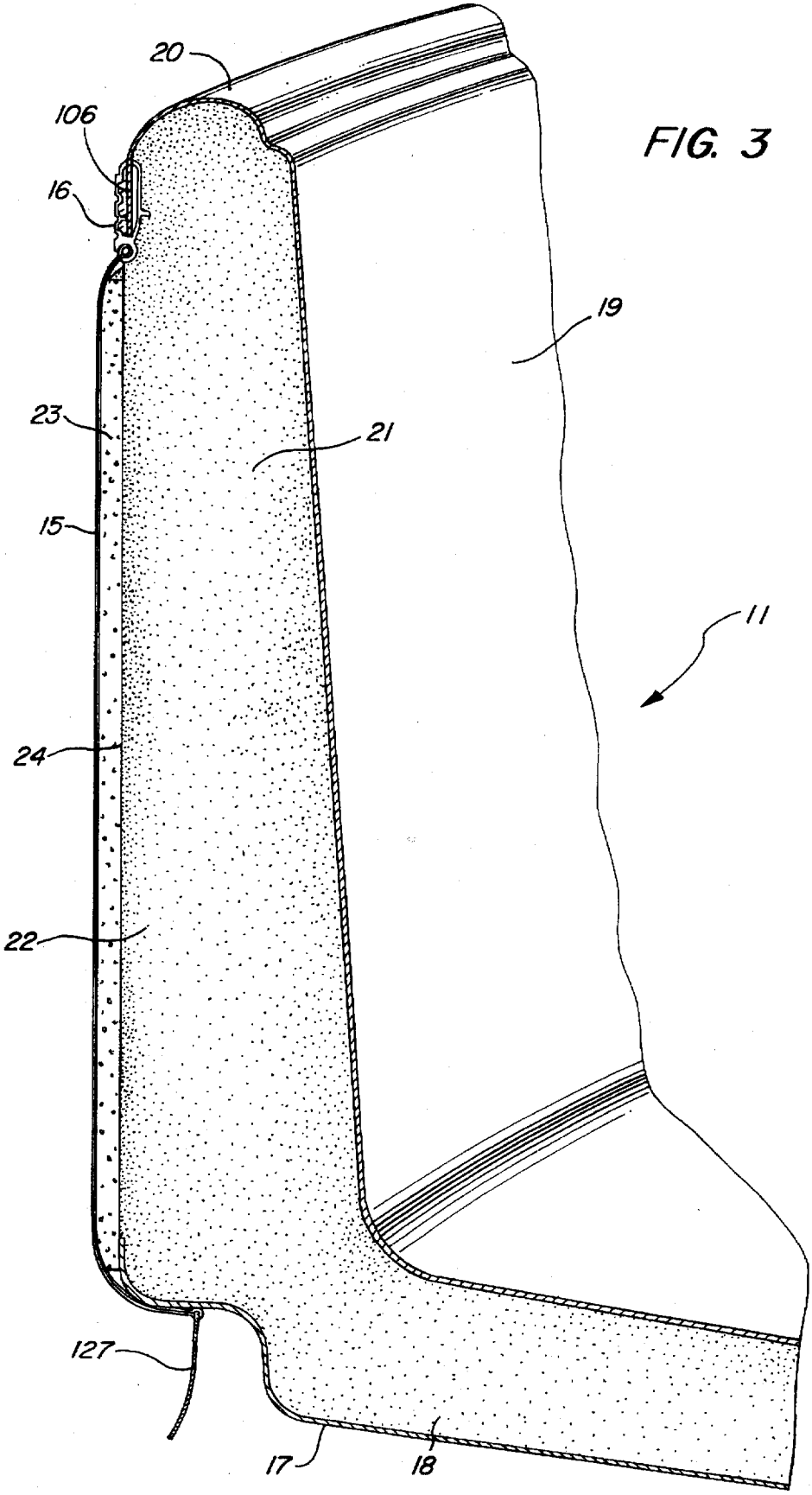
FIG. 3 is a partial side sectional view of a spa according to the preferred embodiment.

As shown in FIG. 3, the spa interior is provided by a molded shell 19, which may be molded from fiberglass, acrylic, polypropylene, or other materials. The shell 19 includes a crowned upper rim 20 having depending vertical edge or lip 106. Adjacent the shell 19 is a layer of rigid foam insulation 21 which defines the exterior contour of the spa 11, providing a bottom surface 18 and a side surface 22. The foam insulation 21 is preferably a rigid, two-pound density, closed cell, polyurethane foam. The bottom surface 18 is contoured to conform to the interior surface shape of the bottom pan 17. The bottom pan 17 itself is waterproof and is glued to the rigid foam insulation 21 in order to provide a sealed, water impervious surface. The interchangeable skirt 15 is positioned adjacent the side surface 22 and includes interior foam padding or batting 23 and a backing layer of cloth material 24. The upper edge of the interchangeable skirt 15 inserts within the lower edge of an extrusion 16, which attaches to the depending vertical edge 106 of the spa rim 20, as described below in more detail.

Figure 7:
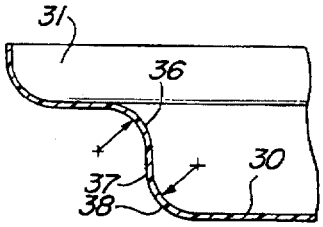
FIG. 7 is a sectional view taken at 7—7 of FIG. 4.

The bottom pan 17 is shown in more detail in FIGS. 4–7. The bottom pan 17 is preferably molded polyethylene and has a generally circular floor 30 surrounded by a contoured rim 31. A cutout 33 is formed in a portion of the rim 31 to provide ventilation to housed equipment such as a pump and heater. As shown in FIG. 7, a generally undulating surface 37 interconnects the rim 31 to the floor 30 of the bottom pan 17. The undulating surface 37 descends to the floor 30 through first and second 90-degree bends 36 and 38, first turning vertically downward through bend 36, and then turning horizontally through bend 38.

Figure 8:
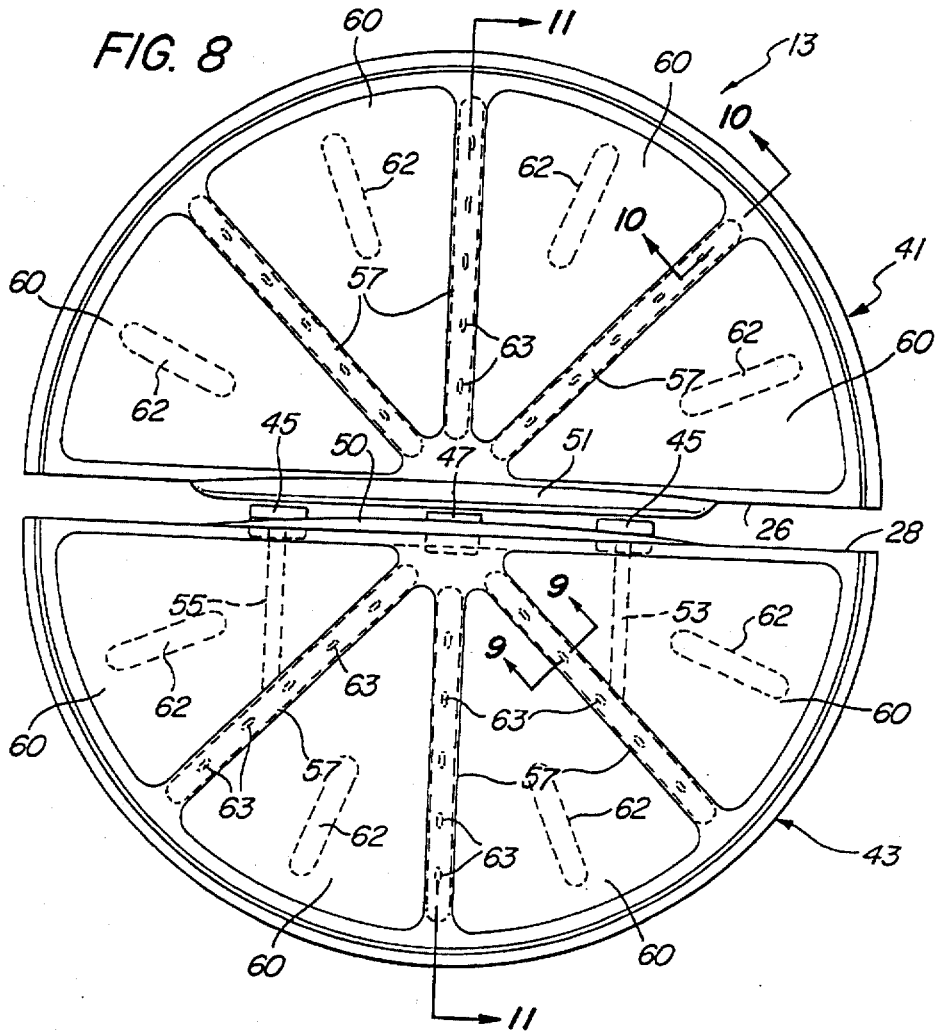
FIG. 8 is a top view of the spa cover according to the preferred embodiment.

The top cover 13 according to the preferred embodiment is shown in more detail in FIGS. 8–15. The top cover 13 shown in FIG. 8 is generally circular and includes a female half 41 and a male half 43. These halves 41, 43 are adapted to abut one another along corresponding edges 26, 28. Each half 41, 43 further includes three identically-formed ribs 57, which separate or define four pie-shaped sections 60. Each cover half 41, 43 is a unitary part, preferably rotationally molded plastic, although injection molding might be used.

Figure 9:
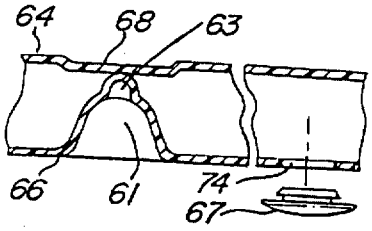
FIG. 9 is a sectional view taken at 9—9 of FIG. 8.

As shown in FIG. 9, each rib 57 is formed by molding the bottom lower surface 66 of the particular cover half 41, 43 to conform to a bell-shaped cross-section, thereby forming a bell-shaped channel or impression 61. At regular intervals, the bell-shaped channel 61 is further provided with domes 63, which extend to meet a recess 68 in the upper surface 64 of a respective cover half 41, 43. Five such domes 63, equally spaced from one another, may be provided in each rib 57. This overall structure provides strength and rigidity to the respective cover halves 41, 43.

Additional intermediate channel areas 62 are also preferably provided to add additional strength to the structure. These channel areas may be substantially identical in cross-section to that of the ribs 57 shown in FIG. 9. Two domes 63 are preferably provided in the intermediate channels 62.

As further illustrated in FIG. 9, openings 74 are provided in the lower surface 66 of each cover half 41, 43. These openings 74 are filled with foam beads such as polystyrene beads, and then plugs 67 are inserted. The beads provide insulation to the cover 13. Such beads could also provide additional structural rigidity if the foam beads were molded into a core at the end of the rotational mold cycle.

In the foregoing manner, the cover 13 is provided with an inner skin 66 and outer skin 64 spaced apart from one another, for example, by a mean spacing of 70–80 millimeters, except at a number of selected areas where the two surfaces are brought adjacent to one another by the dome structures 63, thereby facilitating a rotational molding process. A sealed interior providing desirable insulation characteristics is additionally achieved.

Figure 10:
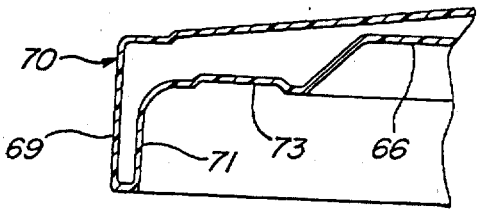
FIG. 10 is a sectional view taken at 10—10 of FIG. 8.

As shown in FIG. 10, the top surface of each cover section 41, 43 angles gently downward to an outer rim 70, which includes an outer vertical wall 69 and an inner vertical wall 71. The inner vertical wall 71 curves through a 90-degree radius to a slightly recessed channel 73 molded to meet and rest on the rim 20 of the spa 11 in order to provide an adequate and effective seal therewith. If desired, this recessed area 73 may be provided with a strip of insulating material to provide a seal between the rim 20 and the cover 13. The rim 70 thus provides a depending skirt which surrounds the outer circumference of the spa 11 and retains the cover 13 in place on the spa 11.

The cover halves 41, 43 feature an integrally molded interlocking hinge mechanism provided by an elongated, tapered female hinge projection 51, an elongated, tapered male hinge projection 50, a central finger extension 47, and first and second side finger extensions 45. Molded indentations 53, 55 (FIG. 8) of rectangular cross-section may be provided to strengthen the area behind the side finger extensions 45.

Figure 11:
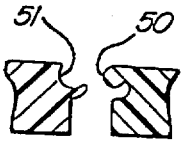
FIG. 11 is a sectional view taken at 11—11 of FIG. 8.
Figures 12, 13, 14:
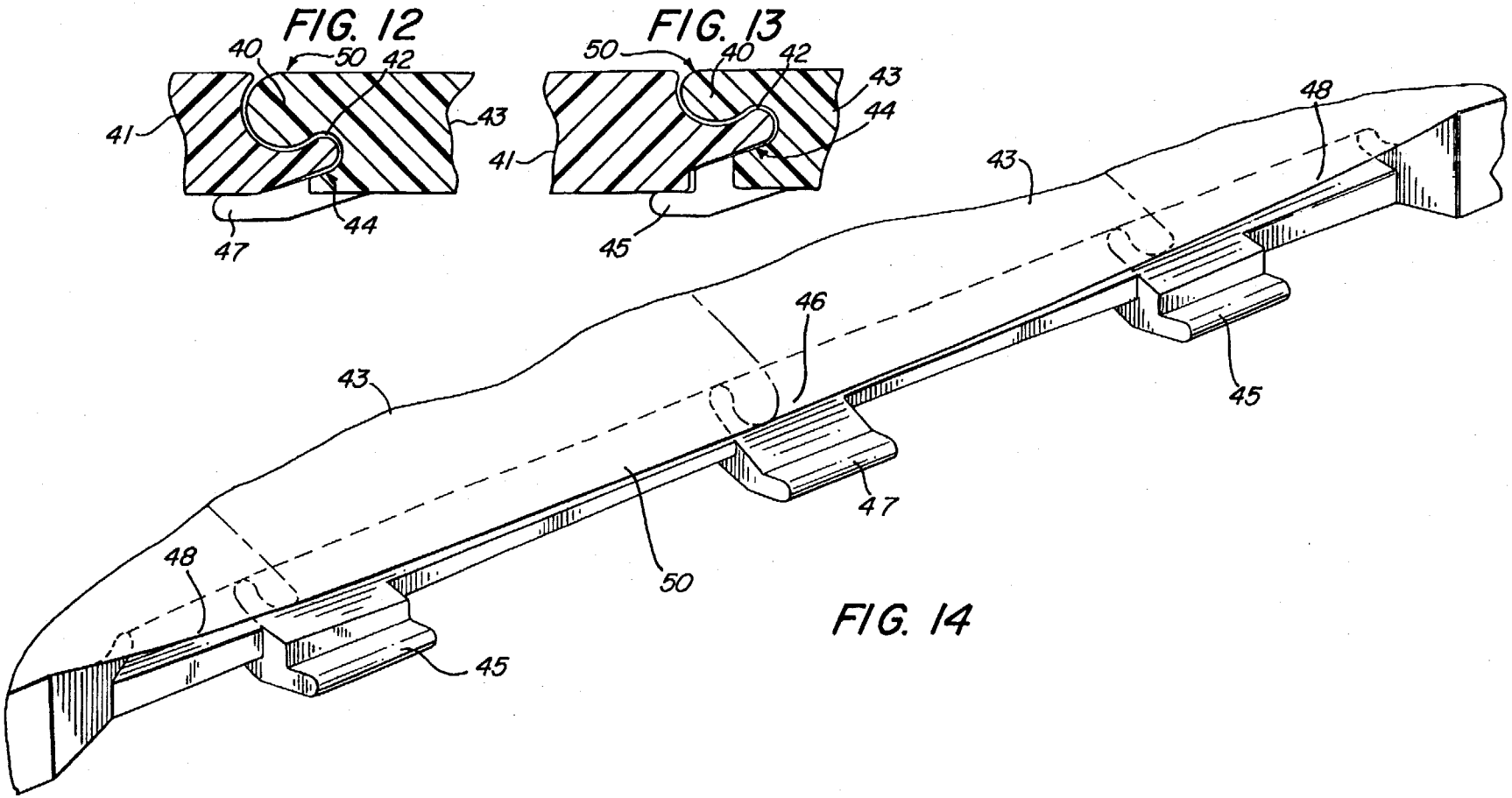
FIG. 12 is a detail of a hinge according to the preferred embodiment.
FIG. 13 is a detail of a hinge according to the preferred embodiment.
FIG. 14 is a partial, cutaway perspective view of a first half of the spa cover according to the preferred embodiment.
Figure 15:
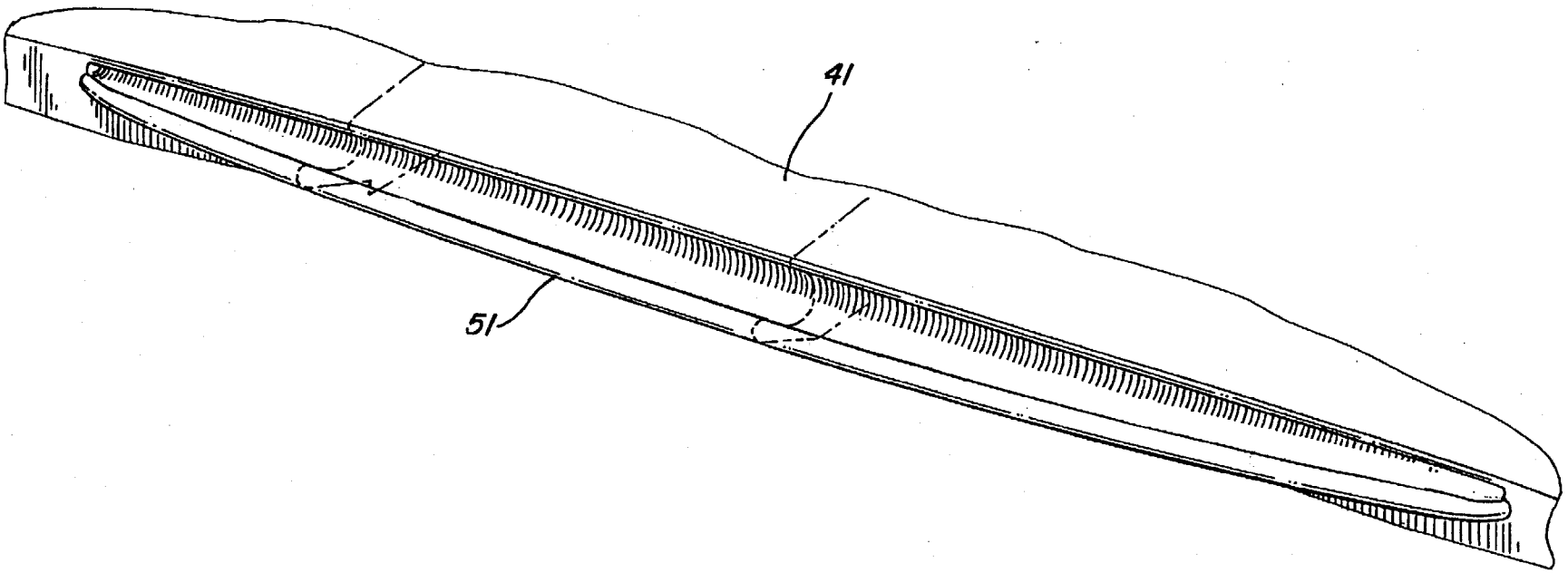
FIG. 15 is a partial, cutaway perspective view of a second half of the spa cover according to the preferred embodiment.

FIG. 11 generally illustrates the cross-sectional mating structure of the elongated, tapered projections 51, 50 at the center of the two halves 41, 43, while omitting the finger detail. FIGS. 12 and 13 illustrate in detail the hinge cross-section at the location of the central finger extension 47 and the side finger extensions 45, respectively. As shown, the male projection 50 generally includes a bulbous portion 40 undercut to form a recessed receptacle portion 42, which curves into a descending, angled floor portion 44. As illustrated, this cross-section continuously and symmetrically narrows from the center 46 of hinge projection 50 toward each end 48 thereof, resulting in a profile which generally recedes away from a relatively prominent bulbous crown 46 at the center 46 toward the ends 48.

The female projection 51 is correspondingly contoured to conform to the varying cross-section of the receptacle 42 and the descending floor portion 44 presented by the male projection 51. The resulting interlocking structure cannot be pulled apart when both cover halves 41, 43 are horizontally disposed, but can be pulled apart when one half is elevated to an acute angle with the horizontal, the angle being determined by the geometry of the interlocking structure, particularly the upsweep of the receptacle 42 and the clamping action between bulbous portion 40 and the finger extensions 45, 47.

Thus, the two cover halves 41, 43, when lying on a flat plane, e.g., when their inner surfaces 73 are supported by the spa rim 20, are restrained from being pulled apart in a horizontal direction by the interaction of the hinge projections 50, 51 and the fingers 45, 47. Engagement and release of these mated, hinged parts is achieved by raising one of the cover halves 41, 43 to approximately 40 degrees above horizontal. At that point, the hinged halves 41, 43 release and allow separation for easier removal, handling, and storage.

The fingers 45, 47 exhibit resilience and are further preferably disposed to provide an interference fit or bias; that is, the fingers 45, 47 are depressed slightly downward against their biased position as the cover halves 41, 43 interlock, and therefore tend to hold the cover halves 41, 43 in interlocking relationship to create a tight fit. This action is particularly desirable in the face of molding tolerances. The fingers 45, 47 also prevent the engaged cover halves 41, 43 from tending to bow in or out, and thus serve to preserve the horizontal interlocking relationship of the cover halves 41, 43.

The natural locking tendency of the two cover shapes 41, 43 prevents horizontal separation and helps maintain a weathertight seal for the spa. The natural locking tendency of the two shapes 41, 43 further discourages unwanted or unauthorized entry of persons into the spa water, when used in conjunction with external lockdown mechanisms (not shown), which secure the cover halves 41, 43 to the spa proper. Thermal efficiency of the complete package is promoted by reducing loss of heat from the spa water that might occur with a nonjoined assembly of cover halves. Such efficiency may be further promoted in some configurations by placement of spongy insulation and sealing material along the portions of the surfaces of the abutting edges 26, 28 which lie adjacent the elongated hinge projections 50, 51.

It may be noted that the structural advantages of the cover 13 shown in FIGS. 8–15 can be adapted to various other cover shapes, for example square or rectangular. In such case, support ribs may run linearly rather than radially and the same or similar hinge mechanism may be used.

Figure 16:
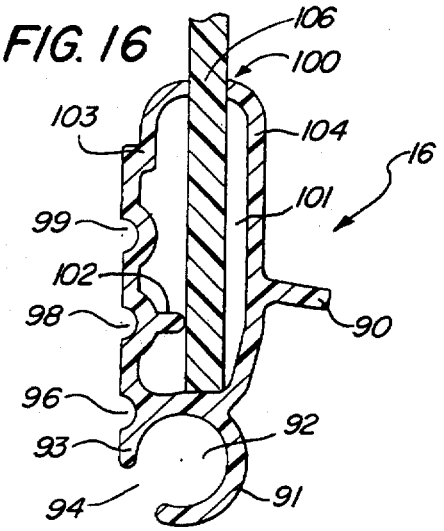
FIG. 16 is an enlarged side sectional view of an extrusion according to the preferred embodiment.

FIG. 16 illustrates the skirt retainer extrusion 16 shown in FIG. 3 in more detail. The extrusion 16 is formed of PVC, for example, Gulf 7045 rigid PVC or Hughes H-600 rigid PVC extruded to the length of, for example, 20 feet, to substantially entirely surround the circumference of the upper rim 20 of the spa 11. The retainer extrusion 16 particularly provides a channel 92 of circular cross-section having an opening 94 on a centerline forming an acute angle, e.g., 56 degrees; with the vertical. The opening 94 receives the upper edge 214 (FIG. 18) of the interchangeable skirt 15, while the channel 92 accommodates a retainer spline 113 (FIG. 19), as hereafter described in more detail. A three-inch break 131 is preferably provided in the channel 92 to facilitate skirt attachment (see FIG. 19).

Above the channel 92 is a second channel 101 having inner and outer side walls 103, 104 and an opening 100 in the top thereof. A projection 102 extends into the channel 101 from the interior surface of the outer side wall 103. The top opening 100 receives the vertical edge 106 of the top rim 20 of the spa 11. The edge 106 is positioned within the channel 101 by the interior projection 102. An exterior projection 90 also extends from the outer surface of the inner side wall 104.

The opening 100 and projection 102 provide an interference fit with edge 106. This interference fit positions and retains the extrusion 16 in place around the rim 20 of the spa 11. After the extrusion 16 is in place, the high density foam 21 (FIG. 3) is applied against the inner side wall 104 and about the projection 90, thereby further fixing the extrusion 16 in place.

In fabricating the extrusion 16, it is desirable to precoil it using a cold form bending procedure, as known in the metal bending industry, to cause the extrusion 16 to take on the shape of a six-foot-diameter circle. In such a procedure, the extrusion 16 is fed between a grooved aluminum wheel and two larger wheels with profiled overmolded rubber. The larger wheels can be moved away from the grooved wheel for loading the extrusion, and toward it (locking at a preset distance) in order to induce sufficient pressure to provide the degree of bending necessary to achieve the desired diameter.

Figure 17:
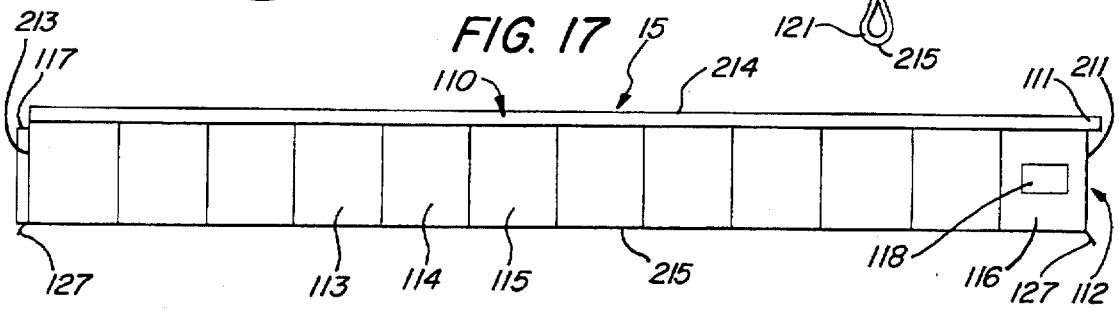
FIG. 17 is a side view of a spa skirt according to the preferred embodiment.

FIGS. 17–21 illustrate the interchangeable spa skirt 15 in more detail. As shown in FIG. 17, the spa skirt 15 includes an upper waistband panel 110 comprising a long, narrow rectangular vinyl section. The panel 110 may be, for example, 19 feet, 3 inches long by 3 inches wide.

The waistband 110 is attached to a second rectangular vinyl section 112 having a greater width, for example, 21½ inches, compared to the width of the waistband 110. The rectangular vinyl section 112 may be considered to be a panel means having a top horizontal edge 14, a bottom horizontal edge 215, and first and second ends 211, 213, which are removably fastenable together, as discussed below. A plurality of panels, e.g., 113, 114, 115, 116, are formed by vertical and horizontal stitching in the section 112. Such stitching forms a lower loop 121, an upper loop 119, and attaches the foam batting panel 23 and cloth backing layer 24. The batting panel 23 preferably gives a cushioning effect and pleasing appearance, while taking up slack and covering imperfections in the rigid foam 21 and may be considered to be a backing means or panel means providing a cushioning effect between the skirt 15 and the spa 11, as well as between the lower section or panel 112 and the spa 11.

Figure 18:
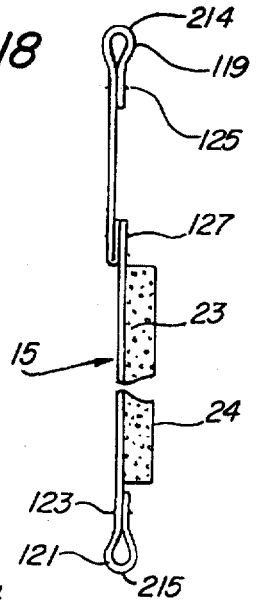
FIG. 18 illustrates a side sectional view of the spa skirt of FIG. 17.

As further shown in FIG. 18, an upper hem 125 defines the upper loop 119, a lower hem 123 defines the lower loop 121, and a seam 127 attaches the waistband 110 to the lower skirt panel 112. The waistband 110 terminates in a three-inch flap 111, while the leftmost edge of the lower skirt panel terminates in a flap 117. One of the panels 116 further includes a flap 118 which may be opened and closed, for example, by means of "VELCRO™" (hook and loop) fasteners in order to expose the control panel (not shown) of the spa 11.

As noted, a zipper 132 is used to attach the ends of the lower vinyl section 112. A drawstring 127, for example, a ⅛-inch nylon cord, is inserted in the lower loop 121 to allow the lower edge of the skirt 15 to be snugly fitted about the lower edge of the spa 11. The lower loop 121 and drawstring 127 may thus be considered to respectively comprise a lower loop means and drawstring means in the lower loop means, as well as a means for providing a snug fit between the bottom horizontal edge 215 and the spa 11 and for thereafter releasing the snug fit.

Figure 19:
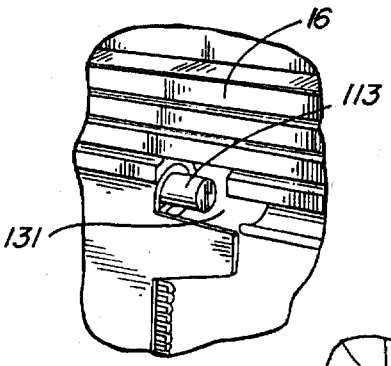
FIGS. 19–21 are side perspective views illustrating installation of the skirt according to the preferred embodiment.
Figure 20:
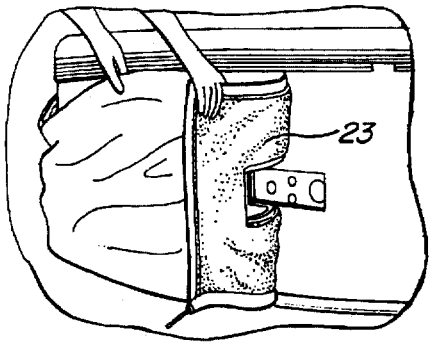
Figure 21:
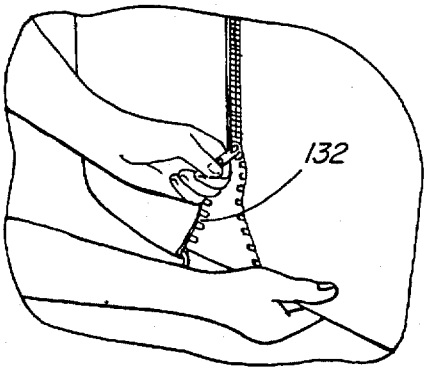

In attaching the skirt 15, the upper loop 119 is inserted into the opening 94 of the skirt extrusion 16 in order to retain the skirt 15 at the upper edge of the spa 11. As shown in FIG. 19, a round spline 113 is provided at a recess 131 in the skirt retainer 16, the spline 113 being driven in to fasten or retain the skirt 15 in position.

Two people can easily install the skirt 15, one person holding the skirt 15 in position, the second wrapping the skirt 15 around the side 22 of the spa 11 while inserting the upper loop 119 into the opening 94 in the skirt retainer 16. The zipper 132 is then closed. The left portion of the skirt 15 may be installed and the left spline 113 inserted, and then the right side of the skirt installed and the right spline 113 (not shown) inserted. The zipper flap 111 is then tucked and the drawstring 127 tied or otherwise secured at the bottom.

As may be appreciated, the opening 94 may be viewed as a means for interfittingly engaging the upper loop 119. An attachment means is further provided including opening 94 and upper loop 119 which provides attachment of the top horizontal edge 214 of the skirt 15 continuously about substantially the entire outer perimeter of the spa 11, the attachment means further providing manual attachment, detachment, and reattachment of the top horizontal edge 214 about the outer perimeter such that the flexible plastic skirt 15 is manually attachable about, removable from about, and reattachable about the outer perimeter a plurality of times by user manipulation, including user manipulation of said attachment means, after the spa has been installed at a user site. As noted at the end of this specification, numerous adaptations and modifications of the preferred attachment means can be employed without departing from the scope and spirit of the invention.

The skirt 15 further provides a flexible plastic skirt means conforming to the shape of the side surface of the spa 11 and wrappable about the side surface for providing a decorative exterior surface and covering thereabout, the plastic skirt means having first and second ends 211, 213, a top horizontal edge 214, and a bottom horizontal edge 215 parallel to the top horizontal edge 214.

The foregoing preferred embodiment exhibits a number of advantages and improvements over the prior art. The integral bottom pan 17 provides greater protection and contributes to the ready portability of the overall spa unit. To illustrate, a spa 27 inches high can be rolled on its side through a 29-inch door. The decorative side skirt 15 can be changed, for example, from a more staid color to a brighter one for festive occasions. The molded, two-piece cover 13 is relatively lightweight, lasts twice as long as conventional foam-based lids, can be fabricated to meet ASTM safety standards, and provides other advantages noted above.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. For attachment about the side surface of a portable spa means for containing a body of water and having an outer perimeter, the apparatus comprising:

a flexible plastic portable spa skirt means for conforming to the shape of said side surface for providing a decorative exterior surface and covering about said side surface, said plastic skirt means having a top horizontal edge, and a bottom horizontal edge, said top and bottom horizontal edges being parallel to one another; and first means located along said top horizontal edge and cooperating with the outer perimeter of said spa means for providing a snug fit of said top horizontal edge continuously about at least 95% of the outer perimeter of said spa means, said first means for providing a snug fit further facilitating manual attachment, detachment, and reattachment of said top horizontal edge about said outer perimeter; said flexible plastic skirt means being manually attachable about, removable from about, and reattachable about said outer perimeter a plurality of times by user manipulation, including user manipulation of said first means, after the spa means has been installed at a user site.

2. The apparatus of claim 1 further including second means for providing a snug fit between said bottom horizontal edge and said spa means and thereafter releasing said snug fit, said first means and second means for providing a snug fit cooperating to facilitate attachment, detachment, and reattachment of said flexible plastic skirt means about said outer perimeter.

3. The apparatus of claim, 2 wherein said skirt means further has first and second ends, wherein said top and bottom horizontal edges and at least one of said first and second ends conform along their periphery to the shape of an elongated rectangle when said skirt means is laid out on a flat surface, and further including means for manually fastening together said first and second ends of said skirt means after said skirt means has been wrapped about said side surface.

4. The apparatus of claim 3 further including panel means disposed between said flexible plastic skirt means and said side surface for providing a cushioning effect between said skirt means and said side surface.

5. The apparatus of claim 4 wherein said flexible plastic skirt means comprises a vinyl skirt.

6. The apparatus of claim 3 wherein said portable spa means is circular and said outer perimeter comprises a circumference of the spa means, wherein the diameter defining the circumference of the spa means is six feet, and wherein said spa means further has a height of 27 inches.

7. The apparatus of claim 1 wherein said skirt means further has first and second ends, wherein said top and bottom horizontal edges and at least one of said first and second ends conform along their periphery to the shape of an elongated rectangle when said skirt means is laid out on a flat surface, and further including means for manually fastening together said first and second ends of said skirt means after said skirt means has been wrapped about said side surface.

8. The apparatus of claim 7 further including panel means disposed between said flexible plastic skirt means and said side surface for providing a cushioning effect between said skirt means and said side surface.

9. The apparatus of claim 8 wherein said flexible plastic skirt means comprises a vinyl skirt.

10. The apparatus of claim 11 wherein said skirt means further has first and second ends, wherein said top and bottom horizontal edges and at least one of said first and second ends conform along their periphery to the shape of an elongated rectangle when said skirt means is laid out on a flat surface, and further including means for manually fastening together said first and second ends of said skirt means after said skirt means has been wrapped about said side surface.

11. For attachment about the side surface of a portable spa means for containing a body of water and having an outer perimeter, the apparatus comprising:

a flexible plastic portable spa skirt means for conforming to the shape of said side surface for providing a decorative exterior surface and covering about said side surface, said plastic skirt means having a top horizontal edge, and a bottom horizontal edge, said top and bottom horizontal edges being parallel to one another; and first means located along said top horizontal edge and cooperating with the outer perimeter of said spa means for providing a snug fit of said top horizontal edge continuously about at least 98.7% of the outer perimeter of said spa means, said first means for providing a snug fit further facilitating manual attachment, detachment, and reattachment of said top horizontal edge about said outer perimeter; said flexible plastic skirt means being manually attachable about, removable from about, and reattachable about said outer perimeter a plurality of times by user manipulation, including user manipulation of said first means, after the spa means has been installed at a user site.

12. The apparatus of claim 11 further including second means for providing a snug fit between said bottom horizontal edge and said spa means and thereafter releasing said snug fit, said first means and second means for providing a snug fit cooperating to facilitate attachment, detachment, and reattachment of said flexible plastic skirt means about said outer perimeter.

13. The apparatus of claim 12 wherein said skirt means further has first and second ends, wherein said top and bottom horizontal edges and at least one of said first and second ends conform along their periphery to the shape of an elongated rectangle when said skirt means is laid out on a flat surface, and further including means for manually fastening together said first and second ends of said skirt means after said skirt means has been wrapped about said side surface.

14. The apparatus of claim 13 further including panel means disposed between said flexible plastic skirt means and said side surface for providing a cushioning effect between said skirt means and said side surface.

15. The apparatus of claim 14 wherein said flexible plastic skirt means comprises a vinyl skirt.

16. The apparatus of claim 13 wherein said portable spa means is circular and said outer perimeter comprises a circumference of the spa means, wherein the diameter defining the circumference of the spa means is six feet, and wherein said spa means further has a height of 27 inches.

17. The apparatus of claim 8 wherein said portable spa means is circular and said outer perimeter comprises a circumference of the spa means, wherein the diameter defining the circumference of the spa means is six feet, and wherein said spa means further has a height of 27 inches.

18. The apparatus of claim 17 further including panel means disposed between said flexible plastic skirt means and said side surface for providing a cushioning effect between said skirt means and said side surface.

19. The apparatus of claim 18 wherein said flexible plastic skirt means comprises a vinyl skirt.

20. The apparatus of claim 18 wherein said portable spa means is circular and said outer perimeter comprises a circumference of the spa means, wherein the diameter defining the circumference of the spa means is six feet, and wherein said spa means further has a height of 27 inches.

21. For attachment about the side surface of a portable spa means for containing a body of water and having an outer perimeter, the apparatus comprising:

a flexible plastic portable spa skirt conforming to the shape of said side surface, said skirt having a decorative exterior surface for covering said side surface, a top horizontal edge, and a bottom horizontal edge, said top and bottom horizontal edges being parallel to one another, said skirt further having first and second ends, said top and bottom horizontal edges and at least one of said first and second ends conforming along their periphery to the shape of an elongated rectangle when said skirt is laid out on a flat surface;

means for manually fastening together the first and second ends of said skirt; and means for providing a snug fit between said bottom horizontal edge and said spa means and thereafter releasing said snug fit, said means for providing a snug fit and means for manually fastening cooperating to facilitate manual attachment, detachment, and reattachment of said flexible plastic skirt about said outer perimeter.

22. The apparatus of claim 21 further including panel means disposed between said flexible plastic skirt and said side surface for providing a cushioning effect between said skirt and said side surface.

23. The apparatus of claim 22 wherein said portable spa means is circular and said outer perimeter comprises a circumference of the spa means, wherein the diameter defining the circumference of the spa means is six feet, and wherein said spa means further has a height of 27 inches.

24. The apparatus of claim 22 wherein said flexible plastic skirt comprises a vinyl skirt.

25. The apparatus of claim 24 wherein said portable spa means is circular and said outer perimeter comprises a circumference of the spa means, wherein the diameter defining the circumference of the spa means is six feet, and wherein said spa means further has a height of 27 inches.

26. The apparatus of claim 21 wherein said portable spa means is circular and said outer perimeter comprises a circumference of the spa means, wherein the diameter defining the circumference of the spa means is six feet, and wherein said spa means further has a height of 27 inches.

27. The apparatus of claim 21 wherein said means for manually fastening comprises a zipper.

28. The apparatus of claim 21 wherein said means for providing a snug fit provides such fit against a bottom pan portion of said spa means.

29. The apparatus of claim 28 wherein said means for manually fastening comprises a zipper.

* * * * *